US005823875A

United States Patent [19]

Tarantino

[11] Patent Number: 5,823,875

[45] Date of Patent: Oct. 20, 1998

[54] WAGER RECEIVING APPARATUS IN A CASINO GAME

[75] Inventor: Elia R. Tarantino, Reno, Nev.

[73] Assignee: Game Data, Inc., Reno, Nev.

[21] Appl. No.: 584,761

[22] Filed: Jan. 11, 1996

[51] Int. Cl.[6] ..... A63F 1/06

[52] U.S. Cl. ..... 463/29; 463/25; 273/309; 273/274

[58] Field of Search ..... 273/309, 292, 273/274; 463/12, 13, 25, 26, 27, 29

[56] References Cited

U.S. PATENT DOCUMENTS

| | | | |
|---|---|---|---|
| 3,843,133 | 10/1974 | Brown | 273/282.1 |
| 4,836,553 | 6/1989 | Suttle et al. | 273/292 |
| 4,861,041 | 8/1989 | Jones | 273/274 |
| 5,393,067 | 2/1995 | Paulsen et al. | 273/292 |

*Primary Examiner*—Benjamin H. Layno
*Attorney, Agent, or Firm*—Townsend and Townsend and Crew

[57] ABSTRACT

A method provides a bonus component to a table game involving one or more players. The method involves each player wishing to participate in bonus play first indicating participation in the table game, then wagering a game token on one or more of a number of predetermined card compositions. The game commences and each player is dealt a hand of game playing cards. If any players' hand of game playing cards includes a one of the number of predetermined card compositions, corresponding to a wagered bonus, the player making the wager wins the wager. A game table, having a dealer station and a number of player stations, is structured to provide acceptance of wagers. The game table includes, at each player station, apparatus forming a wager-receiving recess for accepting a wager—typically in the form of a token. A sliding cover is movable between a first position that exposes the recess, and a second position that inhibits further wagering by blocking the recess. The dealer station includes a control for causing movement of the sliding member between the first and second positions.

16 Claims, 2 Drawing Sheets

WAGER RECEIVING APPARATUS IN A CASINO GAME

BACKGROUND OF THE INVENTION

The present invention relates generally to a casino game, and particularly to a casino table game in which bonus betting is allowed. The invention is particularly suited for use in connection with poker-type table games, and is described in terms of "Texas Hold 'Em" style poker, although as those skilled in this art will see, the invention can be adapted for use in other table games. Apparatus adapted for use with the method of the invention is also disclosed.

Of the many table games available in casinos, perhaps one of the most popular are those table games set for poker play. One drawback of poker, however, from the viewpoint of the house (casino) is that revenue is limited to a percentage of the pots bet. Thus, poker tables that do not draw more than two or three players are obviously not as profitable than those with involving upwards of eight to ten players. However, a poker game that would increase the house's profit must take care not to do so at the expense of excitement to the player, else it becomes self-defeating by keeping players away. That is, any changes to the traditional game in order to increase a house's take must also augment a player's interest in order to attract and keep more players.

There are casino games in which progressive bonus pots are provided players. For example, the traditional five-card stud poker game has been modified so that the dealer plays against each of the players at the table. After an ante, cards are dealt, and a round of betting occurs for those players wishing to continue, concluding with the dealer showing the cards of his hand—which must be of a predetermined value for the dealer to continue. If the dealer's cards are not of the predetermined value, the dealer pays all remaining players; if the dealer remains, the dealer's cards are compared to each player to determine whether the dealer's cards are better than those of each player, paying the player when they are not, collecting when they are.

A drawback of such a game is that the players chances are based solely upon the cards received by the player and dealer. There is no advantage to paying at a table with a large number of players; rather, it is disadvantageous in certain respects, from the player's point of view, because the more players there are the slower the play.

Yet another casino card game employs an adjunct to the game in the form of a bonus pot. Players participating in game play, such as by betting an ante, become eligible to participate in the bonus pot with an additional bet. If, during play, the player's cards are of a predetermined arrangement, the player wins a portion of the bonus pot. This game also suffers from the lack of any advantage to paying at a table with more players.

Examples of these table games may be found in U.S. Pat. Nos. 4,861,041 and 4,836,553.

SUMMARY OF THE INVENTION

The present invention provides a method of providing a table game having a bonus attribute that makes it advantageous to the player to participate in games having larger number of players. In turn, the house (casino) benefits in that more players per table means more players per dealer.

Broadly, the method of the invention involves providing players with an opportunity of participating in bonus play that augments the basic game itself. Participation in the underlying game (e.g., poker) permits the player to also take part in bonus play by one or more wagers. Each wager in the bonus play is a bet that any player at the table, during play of the game, will be dealt a predetermined arrangement of cards. Any player participating in the bonus play, and picking the particular predetermined card arrangement will be paid, as the bonus, a set amount. Should the predetermined card arrangement not be obtained by any player, or that was not the particular arrangement bet upon in player's participation in bonus play, the player losses the bonus bet.

Also disclosed is apparatus in the form of a bonus-play station for accepting bets to indicate participation. Each bonus-play station is under dealer control in that the dealer can open the bonus-play stations to permit betting, and can close the stations to preclude further betting until the next betting period is entered.

Broadly, the bonus-play station comprises a housing structured to be inlaid in the game table. The housing includes a coin or token-receiving location at which a coin or token is placed to indicate participation in bonus play. The housing further includes a sliding shutter that moves from a first, open position to expose the token-receiving location for acceptance of a token, to a second, closed position to prevent removal of the bonus play wager, preventing any additional bonus play wager. When the sliding shutter is moved from the second, closed position back to the first position to expose the token-receiving location, any tokens earlier thereat placed and covered by the sliding shutter are moved along a coin pathway to a coin drop, and deposited in a coin repository beneath the bonus-play station for later pickup.

There are a number of advantageous to the present invention, both to the player, and to the game manager, i.e., the casino. First is the fact that to win bonus play requires participation and a predetermined arrangement of cards being dealt or otherwise obtained by any player—not necessarily the player participating in the bonus play. Thus, the chances of a player winning a bonus play increases with the number of players in the game. Each game, therefore, operates as an enticement to larger numbers of players. This, in turn, increases the profits enjoyed by game management. Larger numbers of players translates to larger pots (from which house management usually takes its percentage for providing game play facilities), and efficient use of the game and employees (i.e., the dealer).

These and other advantages of the present invention will become apparent to those skilled in this art upon a reading of the following description of the invention, which should be taken in conjunction with the accompanying drawings.

DESCRIPTION OF THE PREFERRED EMBODIMENT

Figure 1:
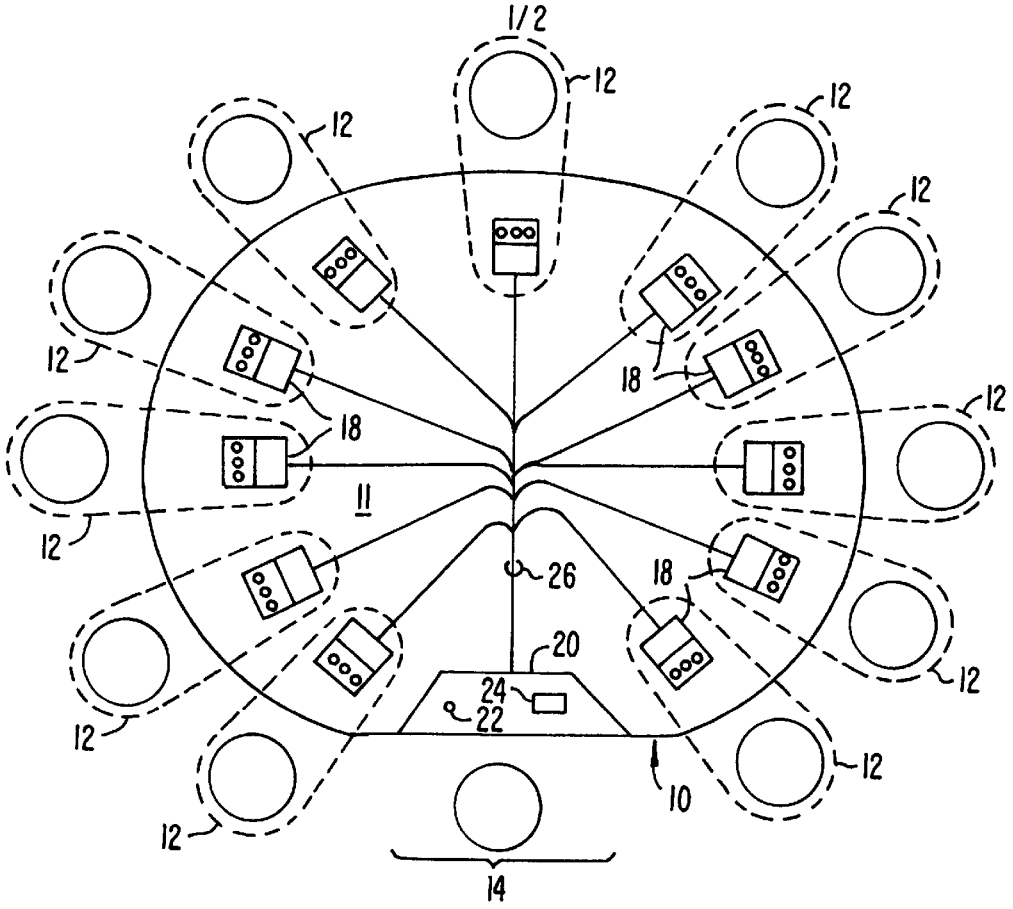
FIG. 1 is a representative view of a game table, illustrating a dealer position, and player positions, each with a bonus-play station.

Turning now to the Figures, and for the moment specifically FIG. 1, illustrated is a game table 10, including player stations 12 and a dealer station 14. Each player station 12 is furnished a bonus-play station 18 for accepting a token or tokens (coins) when a bonus wager is made by the player.

The dealer station 14 includes a control area 20 at which are located a finger-depressible, control button 22 and a display 24. Each of the bonus-play stations 18 is connected to the control button 22 and display 24 by electrical wiring 26. Not shown are connections to a source of electrical power for use as will be explained below.

Figure 2:
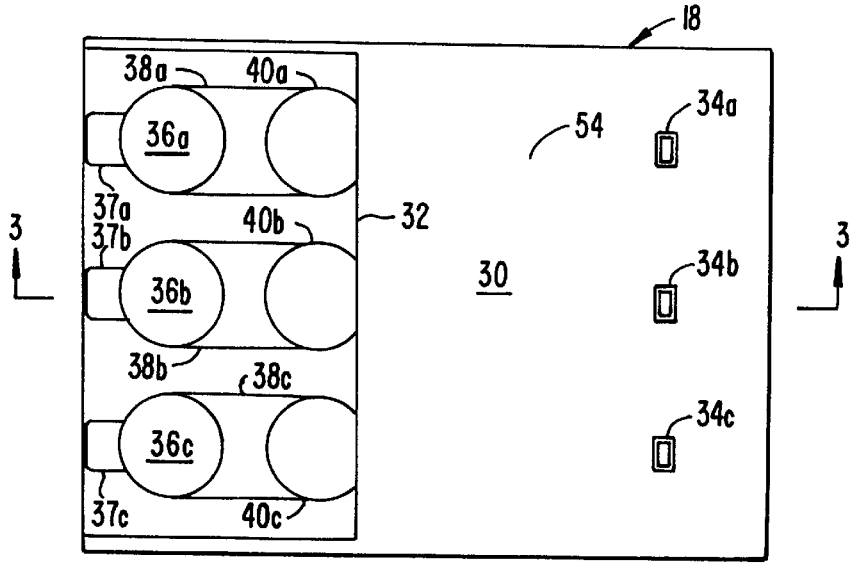
FIG. 2 is a top view of the bonus-play station located at each player position of the game table of FIG. 1.

Referring now to FIG. 2, a bonus-play station 18 is shown in greater detail. Preferably, the bonus-play station 18 is structured to be inlaid in the surface 11 of the game table 10 so that a top surface 30 of the bonus-play station 18 is generally flush with the surface 11 of the game table 10. As will be seen, the bonus-play station is formed from a housing (FIGS. 3A and 3B) that includes a top wall 54 in which is formed an opening 32. Set in the top wall 54 are illuminating elements 34 (34*a,* 34*b,* 34*c*).

Figure 3A:
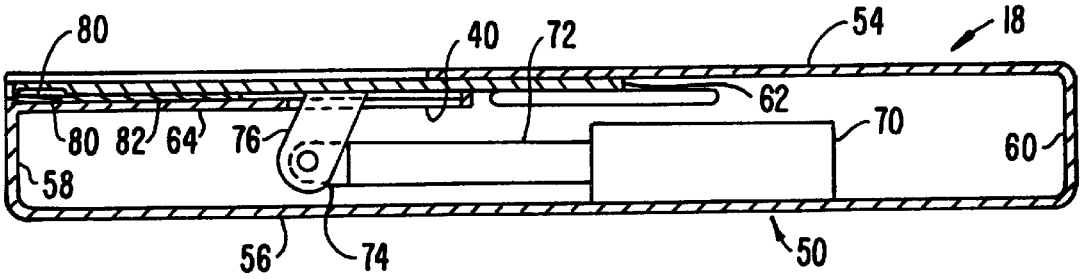
FIGS. 3A and 3B are sectional side views of the bonus-play station, taken along the line 3—3 of FIG. 2 to illustrate operation of the slidable shuttle that moves to lock bonus-play wagers, and inhibit further bonus-play wagers.
Figure 3B:
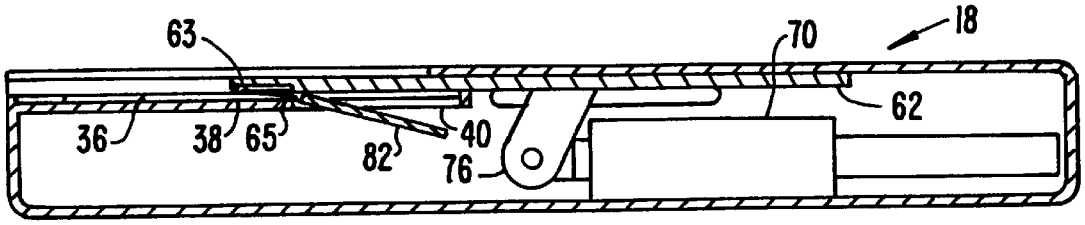
Figure 4:
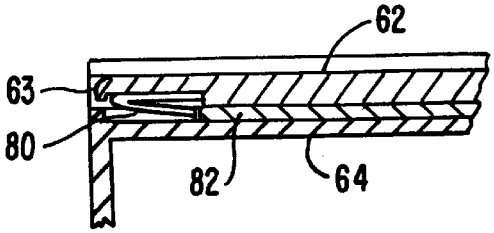
FIG. 4 is an enlarged sectional view of a portion of the bonus-play station, illustrating a bias spring used to move wagered tokens to an exit to a repository when the sliding shutter opens.

Not shown in FIG. 2, but illustrated in FIGS. 3A and 3B, is a sliding shutter that moves between a first position in which it underlies the top wall 54 (which is why the sliding shutter can't be seen in FIG. 2), that exposes token or coin receiving areas 36*a,* 36*b* 36*c* set at one end of recesses 38*a,* 38*b,* 38*c,* respectively. Generally oblong in shape, each of the recesses 38 provide at one end the corresponding token receiving area 36, forming a pathway from the wager-receiving area 35 to a coin-drop aperture 40 (40*a,* 40*b,* 40*c*). As will be seen, bonus-play wagers are indicated by a player placing a token in one or more of the wager-receiving areas 36—when exposed by the sliding shutter (not shown in FIG. 2) in its first position. Placement of a coin in a wager-receiving area signifies the player's wagered intention to participate in one or more of the offered bonus plays. It will also light the corresponding illuminating element(s) 34 so that the player is apprised of his/her wager later. In addition, an indication of the bonus wagers of all players will be presented to the dealer by the display 24.

When all bonus-play wagers have been made by those players wishing to participate, a dealer at the dealer station 14 will cause the sliding shutter (not shown in FIG. 2) to move from its (hidden—in FIG. 2) position beneath the top wall 54 to a second position that overlies the recesses 38 and any tokens that may be placed in the wager-receiving areas 36, effectively locking the bonus-play station from further wagers. When play is complete, and a new game is to start with another round of bonus play, the dealer will command the sliding shutters to return to the first position beneath the top plate 54, again exposing the wager-receiving areas 36 for another round of bonus play. At the same time, aa described more completely below, the movement of the sliding shutter will induce a concomitant movement in any wagers earlier placed for bonus play along the recesses 38 from the wager-receiving areas 36 to the corresponding aperture 40, where the wager (coin or token) will drop through to a repository (not shown) beneath the table.

Not specifically shown is the fact that each wager-receiving area 36 is preferably furnished with a sensing device, such as a small micro-switch or an conventional optical sensor, to detect the presence of a wager. Detection will cause the illuminating device 34 corresponding to the wager-receiving area 36 containing a wager to light. This allows a player to see which bonus-play wager was placed after the sliding shutter has been moved to its second position, closing the opening 32, and locking the wager-receiving areas from further wagers. Alternatively, or in addition, the sliding shutter can be fabricated from a material that is transparent or translucent so that wagers can be viewed through the sliding shutter even when in its second position.

The invention is preferably used in connection with poker style table games, although it will be apparent to those skilled in this art that bonus play according to the invention can be adapted to other types of table games. The game "Texas hold 'Em" illustrates the use and advantages of the invention. Briefly, Texas Hold Em is a poker style game in which game play is presided over by a dealer. Participating players will be dealt two cards and the dealer receives five cards. Players will combine their two cards with the dealers five, and the player achieving a five-card arrangement having a poker value greater than the card arrangements achieved by the other players wins. The values of card arrangements are those of conventional poker, i.e., a royal flush (a five-card arrangement consisting of a king, queen, jack, ten and nine of the same suit) is the highest, followed by a straight flush (a five-card sequence of the same suit), four of a kind, etc.

Bonus play, in the context of the present invention, involves assigning to each wager-receiving area 36 a predetermined card arrangement that at least one of the players must achieve for the associated bonus. For example, the wager-receiving areas 36*a* of the wager stations 12 may be associated with the card arrangement for a royal flush. Placing a token in the wager station 36*a* establishes participation in the prescribed bonus paid when any player participating in the underlying game achieves a royal flush card arrangement (using the seven-card combination of the player's and the dealer's cards) during ensuing game play. Similarly, the wager-receiving areas 36*b* could correspond to a straight flush card arrangement, while the wager-receiving areas 36*c* could correspond to four-of-a-kind. A bonus wager is made by placing a token, coin, or other wager-indicating mechanism in the wager-receiving area associated with the card arrangement the player believes will be dealt to someone of the players.

Game play begins by those players wishing to participate, indicating their intention to play with an "ante," typically a token that is placed in front of the player or the general vicinity of the table center. At about the same time, but before any cards are dealt by the dealer, those players wishing to do so will also indicate their participation in bonus play by placing a bonus wager, in the form of a token or coin in one (or more) of the three wager-receiving areas 36. The dealer will then close bonus wagering by depressing the control button 22 at the dealer station 14 (FIG. 1), causing the sliding shutter to cover the bonus wagers. The dealer then deals two cards to each player who has anted, face down. The players may view their cards, and a round (or more) of betting takes place, followed by the dealer taking three cards, face up. More betting ensues. The dealer takes two more cards, each followed by a round of betting. The game concludes with the players remaining in the game turning up their cards. Each player combines the two cards dealt the player with the five dealt the dealer for the best five-card poker hand arrangement. The best poker hand wins.

In addition, if any of the card arrangements correspond to those associated with bonus play, i.e., should a player's two cards when combined with any three of the five dealt the dealer include four of the same kind such as four fives, all players participating in the bonus play and wagering on the possibility of four of a kind occurring will win a predetermined sum associated with that particular card arrangement. The card arrangement need not occur with the cards of the player; a player wins the bonus play only if he/she (1) places a wager that particular card arrangement will occur, and (2) it does occur.

Turning now to FIGS. 3A and 3B, one of the bonus play stations 18 is illustrated in greater detail to show, among other things, operation of the sliding shutter, designated with the reference numeral 62. As FIGS. 3A and 3B show, the bonus play station 18 includes a housing 50 formed, together with the top wall 54, bottom wall 56, and front and back walls 58 and 60. Internal the housing 50 is a mid-plate 64 in which are fashioned the recesses 38 (FIG. 2) and the apertures 40. The mid-plate 64 also forms a base or carrier for the sliding shutter 62. As can be seen in the FIGS. 3A, 3B, the spacing between the mid-plate 64 and the top wall 54 is sufficient to permit the sliding shutter 62 to move therebetween to and from its first and second positions.

As has been explained above, the sliding shutter 62 moves between two positions: a first position (FIG. 2) that locates the sliding shutter beneath the top wall 54, and exposes the wager-receiving areas 36; and, a second position, covering the wager-receiving areas. This second position of the sliding shutter 62 is shown in FIG. 3A, while FIG. 3B illustrates movement of the sliding shutter 62 from its second position back to the first position. Movement of the sliding shutter 62 is effected by a drive mechanism 70, which could be an electrically actuated solenoid. The drive mechanism 70 includes a plunger 72 whose distal end 74 attaches to a depending shutter arm 76. The shutter arm 76, in turn, is connected to the sliding shutter 62. Not specifically shown is the slot that may need to be formed in the mid-plate to permit connection between the shutter arm 76 and the sliding shutter 62 as well as allowing the shutter arm to move with the sliding shutter 62 as the latter moves between the first and second positions.

The drive mechanism 70 electrically connects to the control button 22 at the dealer station 14 (FIG. 1). The control button 22 works as a toggle switch: when the sliding shutter is in the first position exposing the wager-receiving areas 36, depressing the control button will actuate the drive mechanism 70, causing the plunger 72 to move longitudinally toward the back wall 58, transporting the sliding shutter to the second position; conversely, when the sliding shutter 62 is in the second positions, depressing the control button 22 will cause the drive mechanism to move the sliding shutter 62 to the first position.

Located at a front end 63 of the sliding shutter 62 are three catch springs 65 (only one of which is shown in FIGS. 3A and 3B), one each for each of the recesses 38. When the sliding shutter moves from its first position to assume its second position, the catch spring depresses and closes to ride over any token that may be placed in the corresponding wager-receiving area. When the second position is assumed, as FIG. 3A shows, a slot 37 (FIG. 2), located at the back of the wager-receiving area, permits the catch spring 65 to open. Then, after game play concludes, and a new game is to begin (with a new bonus play offer), the dealer depresses the control button 22 to actuate the drive mechanism 70, causing the sliding shutter 62 to begin movement from the second position illustrated in FIG. 3A, to the first position underlying the top wall 54 and providing access once again to the wager-receiving areas 36. As it does, the now open catch spring 65 engages the periphery of any token 82 that may be located in the wager-receiving area 36, urging the token 82 to the drop aperture 40 where, as the sliding shutter 62 continues its travel to the first position, as shown in FIG. 3B, the token is allowed to drop through, and into an underlying collection repository (not shown).

As indicated above, each of the wager-receiving areas 36 would provide a predetermined bonus amount payment should a wager by placed, and the related card arrangement be dealt to a player. For example, the wager-receiving area 36*a* of each bonus-play station 18 would provide a bonus payment of a first amount should the cards dealt one of the game's players, together with those of the dealer, be a royal flush. The wager-receiving area 36*b,* on the other had, would pay another amount should a straight flush be achieved, and the wager-receiving area 36*c* pay yet a third amount for four-of-a-kind.

An alternative to the above would be to provide, at each bonus-play station 18, a single wager-receiving station 36 for multiple bonus payments on wagers placed. Thus, a single wager would pay for any one of three (or more, according to bonus rules in place) card arrangements. A player's wager, therefore, would result in a bonus payment if, for example, any player's hand (the two dealt the player, and three of the five, dealt the dealer) were (1) a royal flush, (2) straight flush, or (3) four-of-a-kind. Payment could also be based upon only one card arrangement (the highest) should two or more be achieved, or payment could alternatively be made on all such card arrangements.

While a complete disclosure of the invention has been made, it will be evident to those in this art that various modifications and changes can be made. For example, although three wager areas have been illustrated, there can be any number (including only one, as illustrated in the above described alternative, using a single wager-receiving area 36 at each wager station 18). Further, the wager-receiving area has been shown as a flat, horizontal recessed area for a token that is swept to an exit (the drop aperture) for accumulation in a collection repository. It should be clear that other wager-receiving areas can be used such as, for example, a coin-receiving slot much like those used in vending machines. Further still, although the invention has been disclosed in conjunction with a particular style of poler game (Texas hold Em), it should not be assumed that the invention is so limited; rather, it should be apparent that any style poker game (stud, five card draw, lo-ball, hi-ball) can be enhanced by the bonus play of the present invention. The invention also finds useful advantage in other card games.

What is claimed is:

1. For use in connection with a game table for playing a casino game, the game table being of a type having a player station for each of two or more players and a dealer station for a dealer, apparatus for providing participation in a bonus play of the casino game, comprising:

each player station including a receiving element for accepting a token to indicate participation in the bonus play, the receiving element including a sliding member movable between a first position and a second position that prevents the receiving element from accepting a token;

means for moving the sliding member between the first and second positions; and the dealer station including a control member coupled to the means for moving for causing movement of the sliding member between the first and second positions.

2. The apparatus of claim 1, wherein the receiving element has formed therein a recess fox receiving the token.

3. The apparatus of claim 2, wherein the receiving element includes detecting means for determining that a token has been placed in the recess.

4. The apparatus of claim 3, wherein the detecting means is a micro-switch located to be actuated when the token is placed in the recess of the wager-receiving means.

5. The apparatus of claim 2, including display means for indicating that the recess contains a token.

6. The apparatus of claim 2, wherein the receiving element has formed therein an aperture and a chute between the recess and the aperture for passage of the token, the sliding member including a capture member to engage and move the token from the recess to the aperture when the sliding member moves from the first position to the second position.

7. The apparatus of claim 1, wherein the sliding member is translucent or transparent.

8. The apparatus of claim 1, wherein the receiving element has formed therein a plurality of recesses, each of the recesses structured to receive a token, and means for indicating that one or more of the recesses contain a token.

9. The apparatus of claim 8, wherein means for indicating includes constructing the sliding member to be translucent so that the token can be viewed when in one of the plurality of recesses when the sliding member is in the second position.

10. The apparatus of claim 8, wherein each of the recesses has associated therewith means for detecting presence of the token in such recess, the means for indicating including for each of the plurality of recesses and indicator light that radiates when the token is present.

11. Apparatus for use in connection with a game table for playing a casino game, the table having a plurality of player stations, whereat players play the casino game, and a dealer station, the apparatus providing a plurality of players participation in a bonus play, comprising:

each player station including a receiver element having formed therein a recess for accepting a token to indicate participation in the bonus play, each receiver element including token detecting means for determining that the recess contains the token, a sliding member movable between a first position to expose the recess for receipt of the token and a second position to prevent placement of the token in the recess, and display means for providing an indication that the recess contains a token when the sliding member is in the second position;

means for moving the sliding member between the first position and the second position; and the dealer station including a control coupled to the means for moving for causing movement of the sliding member between the first and second positions.

12. The apparatus of claim 11, wherein the sliding member is translucent or transparent.

13. The apparatus of claim 11, wherein the receiver element has formed therein a coin chute and a passage between the recess and the coin chute, the sliding member including means to engage and move the token from the recess through the passage to the coin chute when the sliding member moves from the first position to the second position.

14. The apparatus of claim 11, wherein the sliding member is transparent.

15. The apparatus of claim 11, wherein the display means is an illuminating element that illuminates when a token is located in the recess.

16. For use in accepting a wager in the form of a token, apparatus, comprising:

a receiving element having a recess for accepting the token, including a sliding member movable between a first position to provide access to the recess and a second position that prevents receiving element from accepting a token;

means for detecting presence of the token in the recess;

means for indicating that the recess contains the token, including an indicator light that radiate when the token is present;

actuating means for moving the sliding member between the first and second positions; and a control element coupled to the actuating means for causing the actuating means to effect movement of the sliding member between the first and second positions.

* * * * *